US006084513A

United States Patent [19]

Stoffer

[11] Patent Number: 6,084,513

[45] Date of Patent: Jul. 4, 2000

[54] METHOD AND APPARATUS FOR TRACKING A PATIENT

[75] Inventor: James Stoffer, Delafield, Wis.

[73] Assignee: Innovative Control Systems, Waukesha, Wis.

[21] Appl. No.: 08/939,054

[22] Filed: Sep. 26, 1997

[51] Int. Cl.[7] ..... G08B 13/14

[52] U.S. Cl. ..... 340/572.2; 340/572.1; 340/573.1

[58] Field of Search ..... 340/572.2, 573.4, 340/551, 572.1, 572.4, 552, 573.1

[56] References Cited

U.S. PATENT DOCUMENTS

| | | | |
|---|---|---|---|
| 4,135,184 | 1/1979 | Pruzick | 340/572 |
| 4,303,910 | 12/1981 | McCann | 340/572 |
| 4,622,542 | 11/1986 | Weaver | 340/572 |
| 4,779,076 | 10/1988 | Weaver | 340/572 |
| 4,791,412 | 12/1988 | Brooks | 340/572 |
| 4,851,815 | 7/1989 | Enkelmann | 340/571 |
| 4,853,692 | 8/1989 | Wolk et al. | 340/573 |
| 4,885,571 | 12/1989 | Pauley et al. | 340/573 |
| 4,918,432 | 4/1990 | Pauley et al. | 340/573 |
| 4,980,671 | 12/1990 | McCurdy | 340/568 |
| 5,014,040 | 5/1991 | Weaver et al. | 340/572 |
| 5,079,541 | 1/1992 | Moody | 340/573 |
| 5,117,222 | 5/1992 | McCurdy et al. | 340/573 |
| 5,298,884 | 3/1994 | Gilmore et al. | 340/573 |
| 5,353,011 | 10/1994 | Wheeler et al. | 340/572 |
| 5,440,295 | 8/1995 | Ciecwisz | 340/573 |
| 5,512,879 | 4/1996 | Stokes | 340/573 |
| 5,745,036 | 4/1998 | Clare | 340/572 |

*Primary Examiner*—Jeffery A. Hofsass
*Assistant Examiner*—Sihong Huang
*Attorney, Agent, or Firm*—George R. Corrigan

[57] ABSTRACT

A system for monitoring a person in a secured zone is disclosed. One or more transmitters transmit a first signal into the zone. The person wears a tag that receives the first signal. The tag transmits a second signal that is responsive to the first signal. A receiver receives the second signal and provides a third signal responsive to the first signal. A controller is connected to the receiver and includes a discrimination circuit that determines if the third signal is responsive to the first signal. The controller provides an alarm signal if responsiveness is found. The responsiveness may be a constant phase relationship, and data may be transmitted by the tag at a frequency derived from the first frequency. A three loop antenna, with each loop disposed in a unique plane is described. Each unique plane is substantially perpendicular to the other unique planes, in another embodiment. The tag includes a band removal circuit that senses the skin resistivity of the patient in another embodiment. The tag may also include a chest band that senses the respiration of the patient. The tag includes a power circuit that reduces power consumption in the event the second signal is not being transmitted.

24 Claims, 12 Drawing Sheets

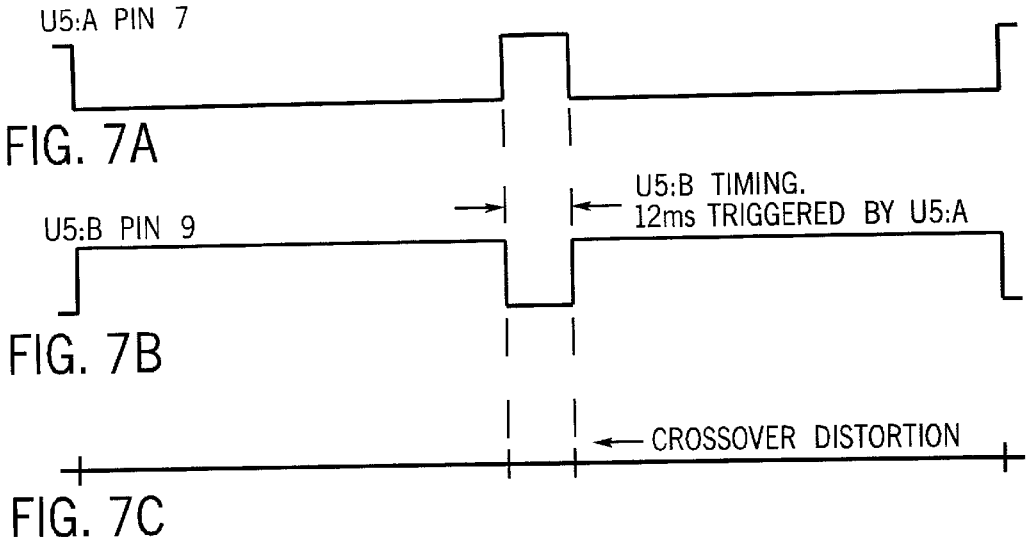
FIG. 7A
FIG. 7B
FIG. 7C
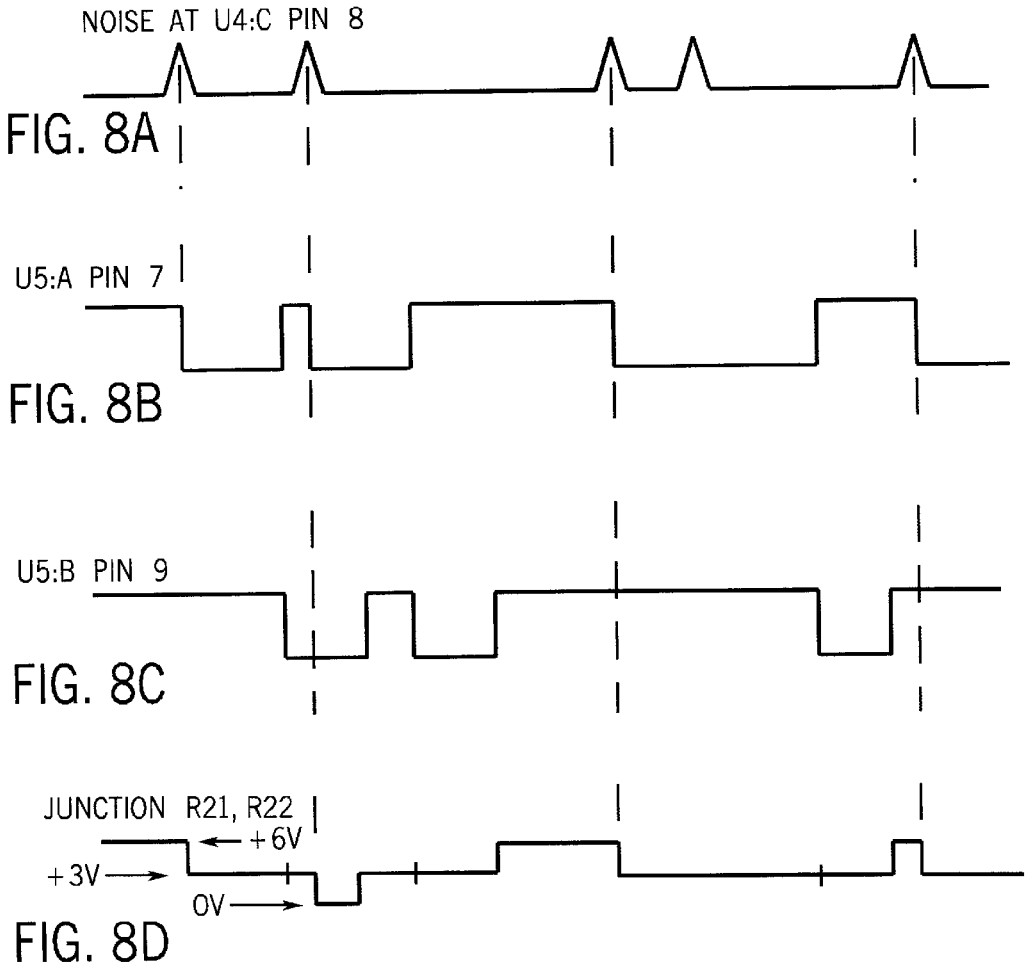
FIG. 8A
FIG. 8B
FIG. 8C
FIG. 8D

P2
+6V
S4
W
R116
CW
R107
R110
R56
R66
R57
R65
R118
D27
C62
U25:A
C63
U25:B
C61
+6V GND
C64
R52
U22:B
FROM

U24:A
U:24B
FROM

U2:F
P3
R105
Q13
P4
U20:C

METHOD AND APPARATUS FOR TRACKING A PATIENT

FIELD OF THE INVENTION

The present invention relates generally to patient security in a hospital or medical care facility. More specifically, it relates to the use of a security tag having a transponder, such as one used in bracelets worn by infants or other patients in hospitals or medical facilities, and one or more stationary transmitters and receivers to detect when the infant or patient leaves a room, area or building.

BACKGROUND OF THE INVENTION

Patient security systems have been used in hospital maternity wards as a deterrent to criminal infant abductions. Other uses of such identification and locations systems include monitoring patients in pediatric and neurologic centers, as well as in nursing homes to reduce the likelihood of an Alzheimer's or head trauma patient wandering out of the facility.

Generally, patients wear a small electronic tag. The tag may be located within a bracelet placed around the patients wrist or ankle, and includes a transponder (transmitter and receiver). The receiver monitors a selected frequency, and is activated when a signal on that frequency is detected. The activating signal originates from an antenna typically located near a door or other exit. The activation occurs when the tag approaches the antenna. Upon activation, the tag transmits a signal to a receiver and control unit, indicating that the wearer of the tag might be leaving the area. The door may then be automatically locked, and/or the staff may be alerted by an alarm such as a bell or flashing lights. The signal transmitted by the tag can include information such as patient name, location of the patient etc. Also, some prior art systems will sound the alarm if the bracelet is cut, to indicate that the patient no longer is wearing the tag.

However, the prior art systems have drawbacks. One such drawback is that the tag may slip off of the patients leg or arm, either intentionally or inadvertently. This is particularly true for infants where weight loss shortly after birth is common. Thus, an initially snug fitting bracelet may become loose fitting. Also, prior art systems typically use a single loop antenna, which produces regions where the transmitted signal has a relatively low intensity (dead zones) in planes perpendicular to the axis of the single loop. Thus, it is possible to have a tag oriented in one or more planes and pass through a protected door without being activated. Also, the prior art systems are not useful other than as locators/trackers—they did nothing to alert personnel to potential medical problems, such as respiratory failure. Other problems with prior security tag systems include the use of high frequency signals which will activate a tag from a greater distance (thus perhaps inadvertently activating a tag) than will lower frequency signals, the need to replace batteries due to power consumption because the tag is "on" at all times, the inability to automatically check if tags are working properly, and false alarms due to random noise.

Accordingly, a security tag that may not be removed without setting off an alarm is desired. Also, such a system should employ antennas that avoid creating dead zones, which comprise security. Such a system should, preferably, be capable of providing an alarm in the event the patient suffers respiratory failure, and should be able to operate at (relatively) low frequencies, with a low standby power consumption, the ability to determine if tags are working automatically, and the ability to avoid false alarms due to random noise.

SUMMARY OF THE PRESENT INVENTION

According to a first aspect of the invention a system for monitoring a person in a secured zone includes one or more transmitters. They transmit a first signal into the zone. The person wears a tag. The tag includes a receiver that receives the first signal. The tag has a tag transmitter that transmits a second signal. The second signal is responsive to the first signal. A receiver receives the second signal and provides a third signal responsive to the first signal. A controller is connected to the receiver and includes a discrimination circuit that determines if the third signal is responsive to the first signal. The controller provides an alarm signal if responsiveness is found. According to a second aspect of the inventor the tag provides the second signal at a fixed phase with respect to the first signal. The controller includes a phase discrimination circuit that determines if the third signal has a fixed phase relationship with the first signal in one alternative.

The transmitter transmits at a first fixed frequency, that may be one of a plurality of selectable frequencies. The tag transmitter is a transmitter that transmits at a second fixed carrier frequency and a data frequency, and the data frequency is responsive to the first frequency according to another embodiment.

An antenna is connected to the transmitter in another alternative. The antenna includes a plurality of loops. There can be three loops with each loop is disposed in a unique plane. Each unique plane is substantially perpendicular to the other unique planes, in another embodiment.

The tag includes a band removal circuit that senses the skin resistivity of the patient in another embodiment. The tag may also include a chest band that senses the respiration of the patient.

In another embodiment the tag includes a power circuit that reduces power consumption in the event the second signal is not being transmitted.

Other principal features and advantages of the invention will become apparent to those skilled in the art upon review of the following drawings, the detailed description and the appended claims.

BRIEF DESCRIPTION OF THE DRAWINGS

FIG. 7 is waveforms of a valid signal detected in accordance with the present invention;

FIG. 8 is wave forms of an invalid signal detected in accordance with the present invention.

Figure 1:
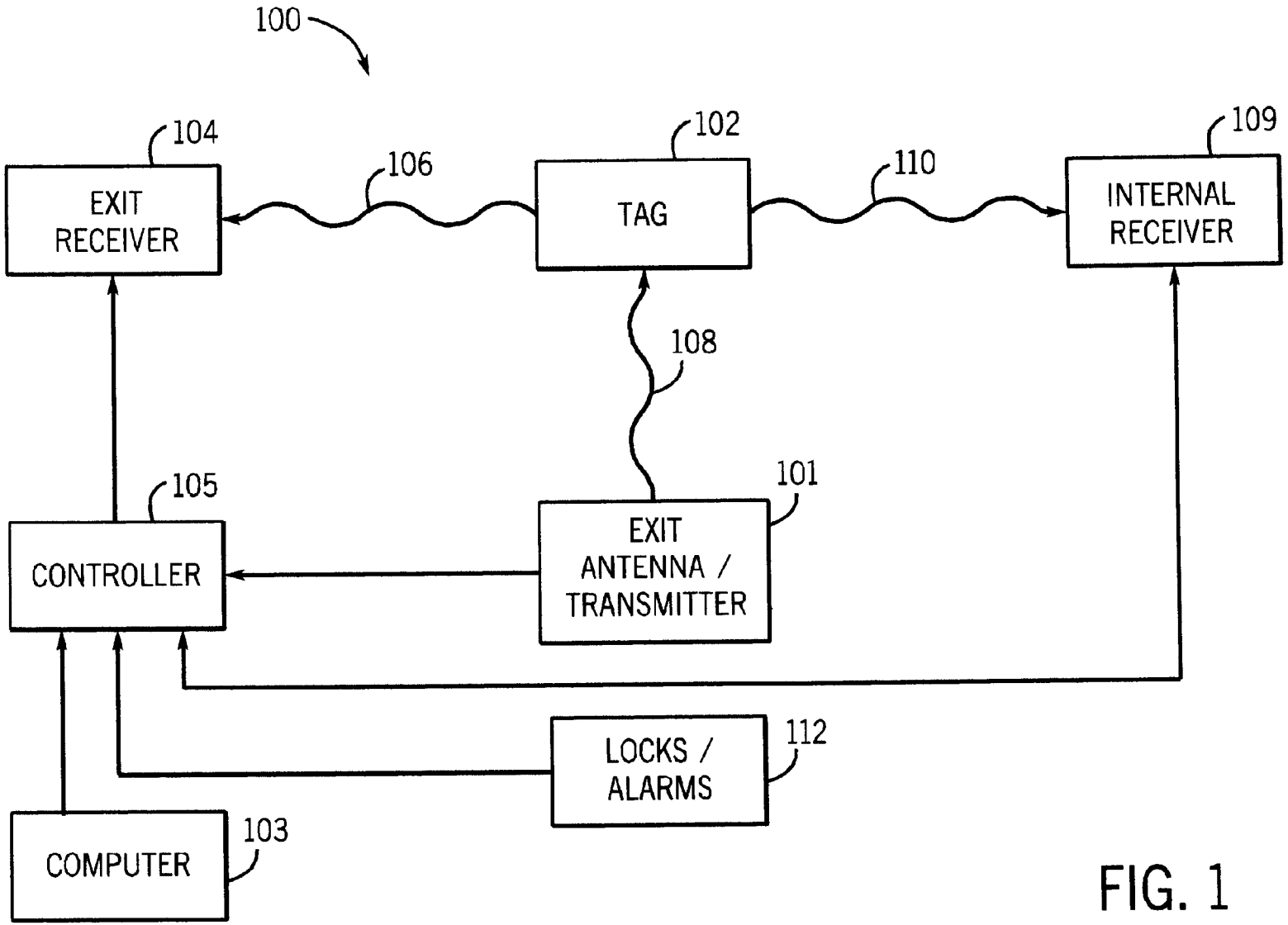
FIG. 1 is a block diagram of a security system constructed in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to an infant security system, it should be understood at the outset that the invention may be employed for other security systems, such as pediatric wards, Alzheimer's patients, head trauma patients, pet care facilities or any situation where there is a need to monitor the departure of people or animals.

Before describing the specific details of the preferred embodiment the general implementation of this invention will be described. The present invention provides security for a zone within a hospital or other facility. FIG. 1 is a block diagram of a security system 100 implementing the present invention, and includes at least one exit antennas/transmitters 101, at least one tag 102, at least one exit receiver 104, a controller 105, at least one internal receiver 109, and at least one door or alarm 112. A attached exit transmitters/antennas 101 transmit activating signals (represented as line 108). Hard wired connections are shown as straight lines in FIG. 1, and electromagnetic signals are shown as wavy lines.

When tag 102 approaches exit transmitter/antenna 101 it receives and recognizes activating signal 108, and tag 102 (which includes a transponder) then transmits a signal 106. Tag 102 is triggered by the magnetic component of the electro-magnetic signal in one embodiment. Signal 106 includes coded information identifying the mother and room number of the infant being monitored when the tag is activated.

Each patient being monitored wears one or more tags 102. The exits of the secured zones have an antenna/transmitter 101 and exit receiver 104 disposed to monitor the exit. Internal receivers 104 are placed at various locations within the secured zone. Controller 105, includes memory and control circuitry for controlling system 100. Alternatively, other information, such as medical conditions can be included, or automatically retrieved from a separate database connected to (or part of) controller 105 when tag 102 is activated.

When tag 102 is activated by exit antenna/transmitter 101, signal 106 is received by the exit receiver 104 that is located near the activating exit antenna/receiver 101. Exit receiver 104 then signals controller 105 of the general location and identity of the activating transmitter. Controller 105 activates an alarm, and/or doorlocks 112 at the exit which tag 102 was approaching. Controller 105 may include a computer 103 for storing data concerning the patient wearing tag 102, or other useful information, as well as perform control functions.

Tags 102 may also incorporate a band-removal feature, which causes a signal 110 to be transmitted by tag 102 if tag 102 is removed. Alternatively, a smaller tag may be used which does not identify the patient and does not generate an alarm when it is removed. This alternative may be particularly useful for neurological patients. Tags 102 also preferably include a low battery feature, which causes tag 102 to transmit a signal indicating the batteries are low.

The plurality of internal receivers 109 are and spaced at intervals within a ward (or other secured zone) depending on the coverage desired. Internal receivers 109 receive the low battery and band removal signal 110 transmitted by tag 102. The band removal and low battery signals may also be received by exit receiver 104. Upon receipt of a low battery or band removal signal receivers 104 and 109 signal controller 105, which locks doors and/or sounds by an alarm.

Exit receiver 104 and internal receiver 109 may be identical. However, in one embodiment, the exit receivers incorporate a feature called the system supervisor or controller (which will be described later) for performing certain self-diagnostic functions. Exit receivers 109 are preferably hard wired to system controller 105, as may be internal receivers 109. In an alternative embodiment, internal receivers 109 are wired to an alarm in the staff alert panel and/or computer 103 at a nurses station.

System 100 includes, in the preferred embodiment, a way to avoid false alarms due to stray electromagnetic signals and noise. Specifically, exit transmitter/antenna 101 includes at least one loop antenna, (preferably three loop antennas) which generate a magnetic field in the proximity of a door being monitored. The receiver in tag 102 is tuned to the same frequency as transmitter 101. Signal 106 is preferably a series of pulses synchronized to the frequency of exit antenna/transmitter 101. This synchronization helps to determine if a signal received is a valid tag signal. Exit receivers 104 and internal receivers 109 monitor the stream of incoming pulses and controller 105 determines if they are frequency-synchronized. If they are frequency-synchronized, a valid-detect signal is generated which activates relays to lock the door and/or sound an alarm. If they are not frequency synchronized, the signals are ignored as noise (or tags responding to a different door). Thus, the system is able to ignore noise and extraneous signals.

The electromagnetic field generated by a single loop antenna is polarized. A polarized signal has dead zones in planes perpendicular to the polarization (determined by the plane of the loop antenna). Thus, the signal for any loop antenna cannot be detected in two planes. Consequently, in a single-loop antenna system a tag oriented in either of the dead planes will not be activated.

Using three loop antennas with each loop orientated in a unique plane, preferably perpendicular to the plane of the other two antennas, will ensure that the tag will be activated in any orientation. Thus, the preferred embodiment uses three such antennas. Since the antennas are oriented at right angles to each other, they will be referred to herein as the X,Y and Z antennas. Other embodiments use one or two antennas, or antennas not in perpendicular planes.

Transmitter 101 generates a relatively low frequency (in the KHz range) signal which is used to activate tags 102 which come near the door being protected. Transmitter 101 transmits, in the preferred embodiment, at one of three operating frequencies: 130 KHz, 132 KHz and 134 KHz. The preferred operating frequency is 132 KHz (132 KHz will be referred to herein as the transmitter frequency, but 130 KHz, 134 KHz are also transmitter frequencies in the preferred embodiment. The preferred frequency range is used because the magnetic field strength is inversely proportional to the cube of the distance from the antenna, while field strength of higher frequency electromagnetic fields fall more gradually, (inversely proportional to the square of the distance). The more rapid decrease of field strength with distance is an advantage because it allows the tag detection zone to be localized in the immediate vicinity of the door (or antenna), and reduces the likelihood tags in adjacent rooms and hallways will be falsely activated. Also, higher frequencies electromagnetic fields are more prone to environmental interference.

Figure 2:
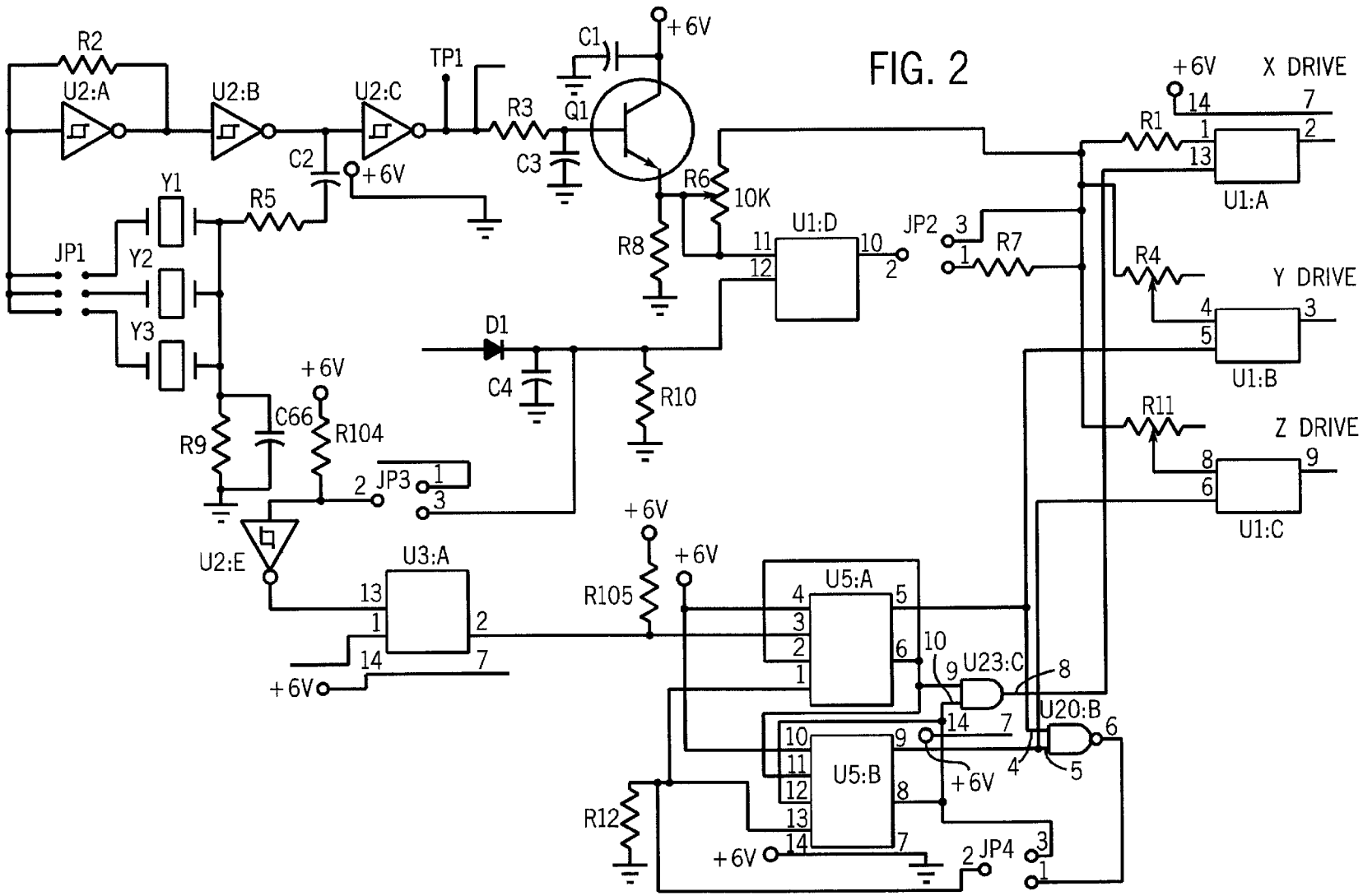
FIG. 2 is a circuit diagram of a transmitter constructed in accordance with the present invention.

Referring now to FIG. 2 a schematic of transmitter 101 is shown. A pair of triggers U2:A and U2:B, and their associated circuitry, a resistor R2 (470K ohms), a resistor R5 (27K ohms), or a capacitor C2 (33 pF), a resistor R9 (27K ohms), and a capacitor C66 (33 pF), form the oscillator that sets the transmission frequency. Three crystals Y1, Y2 and Y3 have oscillating frequencies of 130 KHz, 132 KHz and 134 KHz. The transmission frequency is selected by choosing the appropriate connection of a jumper JP1. Three frequencies are available in the preferred embodiment, as stated above, so that each controller in a facility can (if necessitated by proximity of doors) have a unique frequency. Thus, the system controller will determine if a tag signal being received is synchronized to its own transmitter (as opposed a transmitter at a nearby door). It is desirable to only lock the door which is activating a tag—not adjacent doors in some applications. The preferred arrangement of three different TX frequencies allows systems (or zones) to be located in relatively close proximity to each other. The receiver will recognize if a tag is being excited by (synchronized to) a different system, and will ignore its signal, as described below. An overlap of zone coverage is common since the tags are designed to transmit several hundred feet to implement the band removal feature.

A trigger U2:C, a transistor Q1 and their associated components, a resistor R3 (10K ohms), a capacitor C3 (68 pF), and a capacitor C1 (0.1 $\mu$F) buffer the oscillator signal. Resistors R5, R9, and capacitor C66 help establish the oscillation. A pair of resistors R8 (1K ohms) and R6 (up to 10K ohms) set the 132 KHz signal level, or TX GAIN.

The TX OSCILLATOR signal is provided to the three drive circuits (one for each of the X, Y and Z antennas). Resistor R6 provides the master TX GAIN, affecting all three channels. A resistor R4 (up to 5K ohms) is used to independently adjust the relative gain (or BALANCE) of the Y channel. A resistor R11 (up to 5K ohms) used to independently adjust the gain or BALANCE of the Z channel. A resistor R1 (420 ohms) sets the gain of the X channel. Ultimately, the X, Y and Z signals drive three loop antennas located at or near the door.

Only one of the X, Y and Z drive signals is active at a time in the preferred embodiment. Generally, the channels are sequentially activated so that one antenna is transmitting at any given time. The sequencing rate is selected to avoid the likelihood that a tag could pass through the door antenna in a dead zone before the other two channels are sequenced. The circuitry that is used to sequentially selects (or scan) the X, Y or Z drive signals includes a binary counter formed by flip-flops U5:A and U5:B (74HC74), and gates U4:B and U23:C, and a resistor R12 (27K ohms). The counter autoresets after the third count when a jumper JP4 is in the 1-2 position and all three channels (X, Y and Z) are sequenced. Jumper JP4 is placed in position 2-3 to select an X-Y scan for using two antennas. Removing jumper JP4 locks the system on just the X channel for using a single loop antenna, or for allowing the installer to conduct tests.

The outputs of the binary counter are connected to control inputs of a plurality of bilateral switches U1:A, U1:B and U1:C, which are sequentially enabled by the binary counter as it is slowly clocked by a square wave signal (ANTENNA TOGGLE) provided through a switch U3:A. The binary switches also receive the oscillating TX signal, and are connected to the X, Y, and Z antennas.

When a 418 MHz tag signal is detected, the TX driver stops scanning and locks onto the channel that is active (and presumably had activated the tag). In other words, the scanning stops on the particular channel whose antenna is activating the tag. Switch U3:A, a resistor R104 (1M ohms), a trigger U2:E and a resistor R105 (1M ohms) cause the scanning to stop.

Scanning may be inhibited when any tag signal (418 MHz in the preferred embodiment) is detected, or only when a synchronized signal is detected. A faster lock time can be realized if the antennas stop scanning at the first hint of a signal. However, in a noisy environment, spurious 418 MHz signals can interfere and erroneously inhibit scanning the different antennas.

A jumper JP3 is used to set how fast the scanning is inhibited. Jumper JP3 is placed in position 2-3 to inhibit scanning by the detection of any 418 MHz signal. Jumper JPB is in position 1-2 when scanning is inhibited only upon detection of a valid (synchronized) tag signal. Position 1-2 (stop scanning only for synchronized signals) is the preferred setting, although in a quiet electrical environment the other setting may be preferred.

A signal RX DATA, which indicates if any 418 MHz signal is detected is provided to pin 3 of jumper JP3. Thus, when position 1-3 is selected, any 418 MHz signal will cause trigger U2:E to change states. The output of trigger U2:E is provided to the control input of switch U3:A, which either connects or disconnects an Antenna TOGGLE signal to the CLR inputs of FLIP-FLOPS U5:A and U5:B. Resistor R105 (1M ohms) is connected between a +6 V supply and the output of switch U3:A.

If jumper JP3 is in the 1-2 position it connects a DETECT VALID signal (indicative of a detected synchronized signal) to trigger U2:E (which is also connected to the +6 V source by a resistor R104 (1m ohms). Scanning is inhibited by causing switch U3:A to open (which stops binary counter U5:A and U5:B from incrementing). An RX DATA signal is provided through a diode D1, a capacitor C4 (1 $\mu$F), and a resistor R10 (1M ohm) when jumper JP3 is in the 2-3 position.

The 132 KHz transmitter also incorporates an optional automatic gain boost feature. When this feature is enabled the transmitter idles at a reduced signal level. This reduced level minimizes the strength of the TX field so that it doesn't extend into adjacent rooms or hallways. Once a tag gets close enough to detect by the system, the 132 KHz TX gain is increased. A jumper JP2 selects whether full, partial or no gain boost is used. Full gain is selected when jumper JP2 is in the 2-3 position, no gain is selected by opening jumper JP2, and partial gain by the 1-2 position which causes the signal to pass through a 1k ohm resistor R7).

The RX DATA signal (indicating a detected tag) is provided through diode D1 to the control of a switch U1:D. This closes switch U1:D, providing a parallel path to resistor R6 and increasing the magnitude of the signal applied to the antenna drives.

Figure 3:
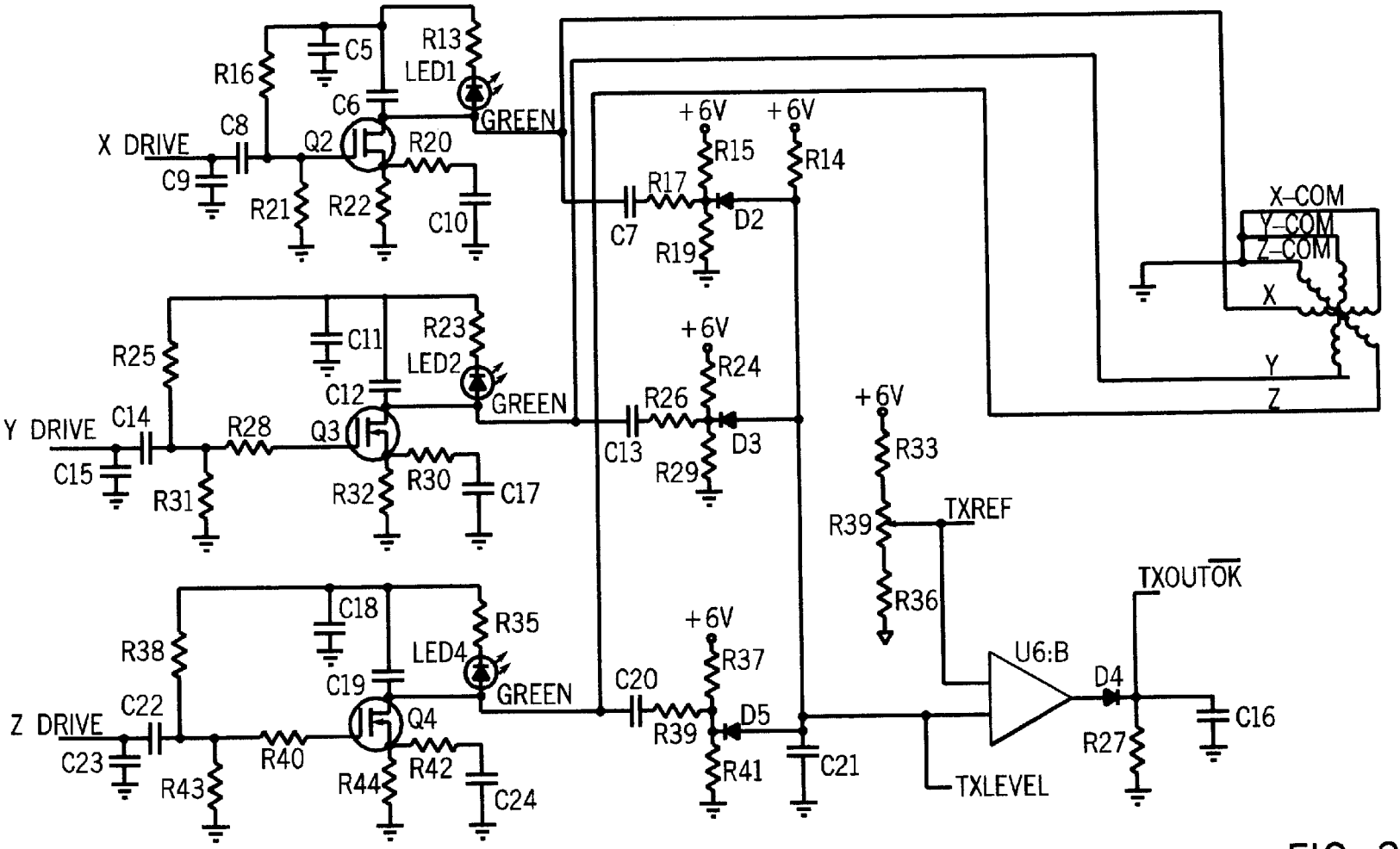
FIG. 3 is a circuit diagram of a transmitter output circuit constructed in accordance with the present invention.

FIG. 3 is a schematic diagram of more of transmitter 101, including the X, Y and Z output drivers that are used to sequentially energize the corresponding X, Y and Z loop antennas. Each channel driver consists of one of three transistors Q2, Q3, and Q4, and their associated. The output channel drivers circuitry transistors Q4, operate as signal amplifiers at the selected frequency 132 KHz in the preferred embodiment.

The detailed operation of the circuitry will be described with respect to the X channel output. The Y and Z channels function in a like manner. The 132K Hz signal provided on the output of switch U1:A (FIG. 2) is provided through an RC network to the gate of transistor Q2. The associated circuitry is comprised of a capacitor C8 (0.1 μF), a capacitor C9 (0.001 μF), a resistor R21 (22K ohms), a resistor R22 (120 ohms), a resistor R20 (22 ohms), a capacitor C10 (0.1 μF), a resistor R18 (220K ohms), a capacitor C5 (0.1 μF) and a capacitor C6 (0.01 μF).

A light emitting diode LED1 (through a 4.7K ohm resistor R13) indicates when the X channel is active. Transistor Q2 is connected to X antenna. The other end of the X antenna is connected to ground. Transistor Q1 is also connected to an op amp U6:B through a capacitor C7 (0.001 μF), a plurality of resistors R14 (1M ohms), R15 (9.1K ohms), R17 (33K ohms), and R19 (27K ohms), a capacitor C21 (0.01 μF), and a diode D2. The components in like positions for the Y and Z channels have similar values.

Op amp U6:B, along with its associated circuitry, a plurality of resistors R33 (1K ohm), R34 (up to 10K ohms), R36 (820 ohms), R27 (68K ohms), a diode D4, and a capacitor C16 (10 μF), provides a signal, TXOUT, indicative of the presence or absence of transmission signal.

The TX outputs sequentially drive resonant loop antennas. The purpose of sequencing the TX signals is to create three distinct field orientations from the three loop antennas as described above. The magnetic flux lines in the zone sequentially rotate through three separate spatial orientations, (preferably at right angles to one-another) as the X, Y and Z antennas are driven. This will minimize "orientation nulls", which occur when the tag is held in certain positions near the door.

Even if a null appears with respect to one antenna (i.e., a tag is not detected), the controller will scan to another antenna, essentially re-aligning the field so that the null disappears. The X, Y and Z loop antennas may be wound on the same form, with the windings perpendicular to each other, or they may be wound on separate forms or located in different locations near a door.

One feature of the preferred embodiment is a band-removal alarm. Thus, the tag signal (i.e. the signal transmitted by the tag) needs to be transmitted for some distance, so that the signal can be received anywhere within a facility using a minimal number of overhead receivers. The desired distance is achieved (in the preferred embodiment) by operating the tags at a relatively high frequency, 418 MHz in the preferred embodiment. Since the 418 MHz distance range is extensive, it is likely that signals transmitted by a tag located near (and activated by) one door will be received by the receivers of other the doors in the immediate area. Thus, the preferred embodiment includes the three selectable frequencies to distinguish which door a tag is near. The TX frequencies on a system controller is selected to be a different (say 132 MHz) from the frequency of adjacent system controllers (say 130 MHz and 134 MHz). This allows the systems to respond only to tags in their own immediate zone.

Figure 4:
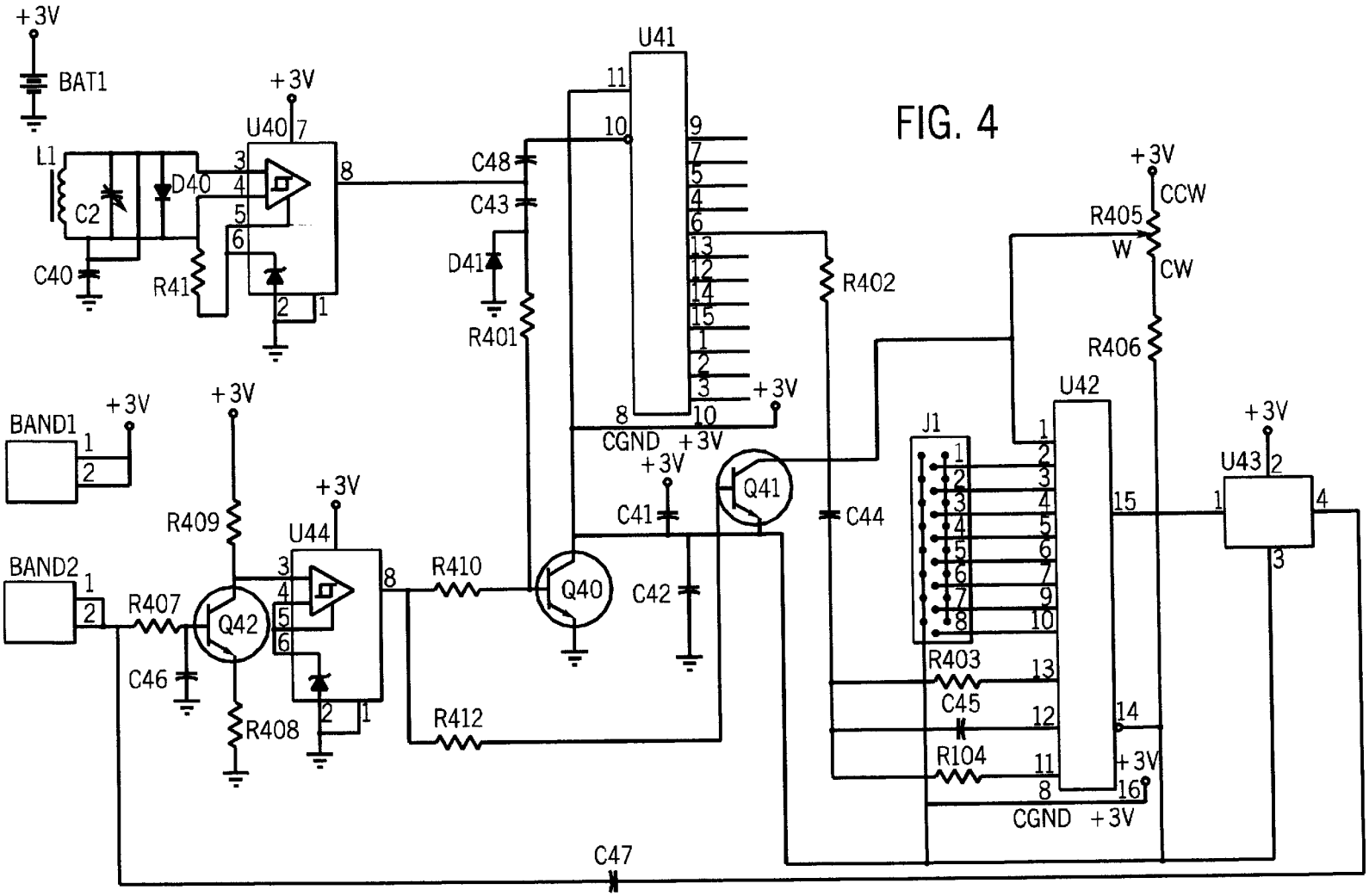
FIG. 4 is a circuit diagram of a patient tag constructed in accordance with the present invention.

FIG. 4 is a schematic of tag 102 used for infants with the present invention. The tag includes a small ferrite loop antenna L1 which is tuned to about 132 MHz. The antenna is an inductor, (21.5 mH), with a trimmer capacitor C2 (9.8–60 pF) across it to center the resonance of the antenna to 132 KHz. 130 KHz and 134 KHz are also within the bandwidth of this tuned circuit. Tuning the antenna assures that only a signal close to 132 KHz, will activate a tag, not noise sources at other frequencies. The antenna circuit includes a capacitor C40 (2 pF) and a diode D40.

When the miniature antenna is brought near the TX field created by an exit antennas/transmitter 101, a small voltage is induced in inductor L1. This small voltage across the ferrite loop bar alternates polarity at the transmission frequency—about 132,000 times each second. Each time the polarity on inductor L1 changes, the output of a comparator U40 (MAX921) changes state, generating a square wave signal at the transmission frequency (132 KHz e.g.). Comparator U40 includes a resistor R41 (1M ohm) in its input circuit.

The 132 KHz square wave generated by comparator U40 passes through a capacitor C43 (0.001 μF), which blocks DC from flowing and draining the battery if the quiescent output state of comparator U40 happens to be high. A diode D41 clamps the square wave, and each time the signal goes high, and current flows in a resistor R401 (1K ohm) turning a transistor Q40 on. The collector of transistor Q40 goes low with each positive half-cycle, discharging a capacitor C41 (22 μF) and charging a capacitor C42 (22 μF). Capacitors C41 and C42 hold the collector of transistor Q40 low through the negative half-cycle, and are used as the negative supply (or switched DC ground) for the rest of the circuitry in the tag. This ground is switched "open" by transistor Q40 when no square wave is present at its base. Thus, the tag is essentially shut off, preserving battery life. The battery drain is less than 5 μA when transistor Q40 is off and about 1.5 mA when transistor Q40 is on.

The square wave from U40 also passes through a DC blocking capacitor C48 (0.001 μF) into the clock input of a counter/divider U41. Counter/divider U41 divides the 130 KHz, 132 KHz or 134 KHz square wave by 128, generating a square wave signal at either 1016 Hz, 1031 Hz or 1046 Hz. This "divided down" square wave is used to synchronize the data clock in a data encoder U42 (MC145026). In an alternative embodiment the divided-down signal modulates a 418 MHz transmitter directly.

The 1031 Hz divided square wave is used to injection-lock the on-board RC oscillator in data encoder U42 via a resistor R402 (18K ohms) and a capacitor C44 (470 pF). By "pumping" the external frequency-fixing components of the oscillator in data encoder U42 with a near-frequency square wave from counter U41, the RC oscillator frequency will match, or be synchronized with, the 1031 Hz signal. The values for resistor R402 and capacitor C44 were chosen to optimize capture range and lock time, as well as to not hinder free-running oscillation when the band-removal alarm described below is activated and no 1031 Hz signal is present. A capacitor C45 (0.01 μF) and resistors R403 (43K ohms) and R404 (82K ohms) are connected as shown.

A unique ID code is programmed into encoder U42 of each tag as it is manufactured. Encoder U42 is a tri-state encoder which generates a serial data word based on parallel inputs to the device. Pins 2–7, 9 and 10 of encoder U42 are data lines which are tied high, low or left open by switches or copper traces on the PC board. This provides 6561 possible codes, but the production version of tags may be limited to less codes by the manufacturing process.

Encoder U42 pin 1 (data line #1) is a data line which is dedicated to flagging the ID data, to indicate either zone detection, band-removal or low-battery condition. Since U42 has tri-state inputs, each input data line controls the status of two output serial data bits. Zone detection is denoted by a high state for U42 pin 1 (provided the battery voltage is sufficient to cross the IC input voltage threshold as set by a calibration pot R405 (up to 50K ohms) and a 47K resistor R406, but if the battery voltage is not sufficient, pin 1 will register as a floating state). A band-removal alarm is denoted by pin 1 being held low by a transistor Q41. The first two serial data bits are, high-high for zone detection, high-low for zone detection with low battery, and low-low for band removal (discussed below).

When the tag is activated, by detecting a 132 KHz signal, data encoder U42 generates a serial data stream, repeating a pre-programmed ID code about once every 94 msec. This serial data stream is applied to the modulation input of a 418 MHz transmitter U43 (RFMHX1003), which transmits the data as a series of 418 MHz bursts.

The serial data being transmitted by transmitter U43 will be sent at clock speeds responsive to the frequency of the door transmitter. A tag near a 130 KHz transmitter will injection-lock data oscillator to 1016 Hz, a tag near a 132 KHz door, will lock to 1031 Hz and near a 134 KHz door the data oscillator will lock to 1046 Hz. The data oscillator is further divided within encoder U43, so that output data pulses are clocked at approximately 254 Hz, 257.75 Hz, or 261.5 Hz, depending on the original transmitter frequency. In each case, the data pulses are synchronized to the original door transmitter signal. If the band removal alarm is triggered (described below) and the tag is not near a zone, the data oscillator is free-running at about 1 KHz, and bits 1 and 2 of the serial data stream are set low.

The preferred embodiment of the system is designed to sound an alarm if a tag is removed from an infant or user, and possibly locking all doors in the facility pending staff intervention. The band-removal alarm employs a network of overhead receivers spaced at intervals throughout the facility. These receivers detect a band removal signal when a band is removed from the infant.

Each tag is attached to the infant by two soft, conductive bands. These bands sense the skin resistance of the infant. If contact to the infant's skin is broken change in resistance is detected, and the tag will transmit the ID data to the overhead receivers. The controller (described below) then generates an alarm condition. The bands connected to the infants skin are shown on FIG. 5 as Band 1 and Band 2. Band 1 is tied to a +3 V source. Band 2 is tied, through a resistor R407 (47 ohms) and a capacitor C46 (0.001 $\mu$F), to the base of a darlington transistor Q42. Darlington transistors are very sensitive to current, so low levels of current, in the microamps range e.g., flowing through a patient's skin from Band 1 to Band 2 is enough to turn transistor Q42 on. This very small current cannot be felt by the patient. Band 2 is also coupled through a capacitor C47 (10 pF) to 418 MHz transmitter U43, and acts as an antenna to enhance the distance range of the tag. Resistor R407 is seen as a 47 ohm load to the output of transmitter U43. Capacitor C47 filters out stray noise signals, blocks RF and provides a delay in turning on transistor Q42 so that momentary loss of skin contact will not activate the band removal alarm.

As long as the two conductive bands are in contact with a moderately high impedance surface, such as skin, no band-removal alarm is initiated. If skin contact is lost, or if the bands are shorted together, a band-removal alarm is initiated.

An alternative embodiment monitors the infants respiration, and can be used for detecting the early stages of SIDS. The respiration detector can be motion based, or use other known techniques. Other alternatives monitor infant characteristics other than resistance or respiration.

Transistor Q42 is configured as a window comparator and its collector floats high (3 V) when the bands are open, but pulls low when a very small amount of current flows in its base through skin contact. If the bands are shorted together in an attempt to defeat the alarm, full current flows in the base of transistor Q42 and in a resistor R408 (47K ohms) and a resistor R409 (1M ohm). As the voltage across resistor R408 rises, the emitter voltage rises, and the collector voltage follows. Thus, the collector of transistor Q43 floats high for open bands, pulls low with skin contact, and is forced high by the emitter for shorted bands.

A comparator U44 (MAX921) is a threshold detector and buffer. The output of comparator U44, pin 8, switches high anytime the collector of transistor Q43 is high, feeding current through a resistor R410 (10K ohms) to turn on transistor Q40. This turns on the tag circuitry. Comparator U44 matches the high collector impedance of transistor Q43 to the relatively low base impedance of transistors Q40 and Q41. Transistor Q41 is turned on through a resistor R412 (10k ohms), and switches data line #1 of encoder U42 low, to modify the data and indicate a band removal. The on-board RC oscillator in encoder U42 free-runs, clocking the modified data to the 418 MHz transmitter.

Figure 5:
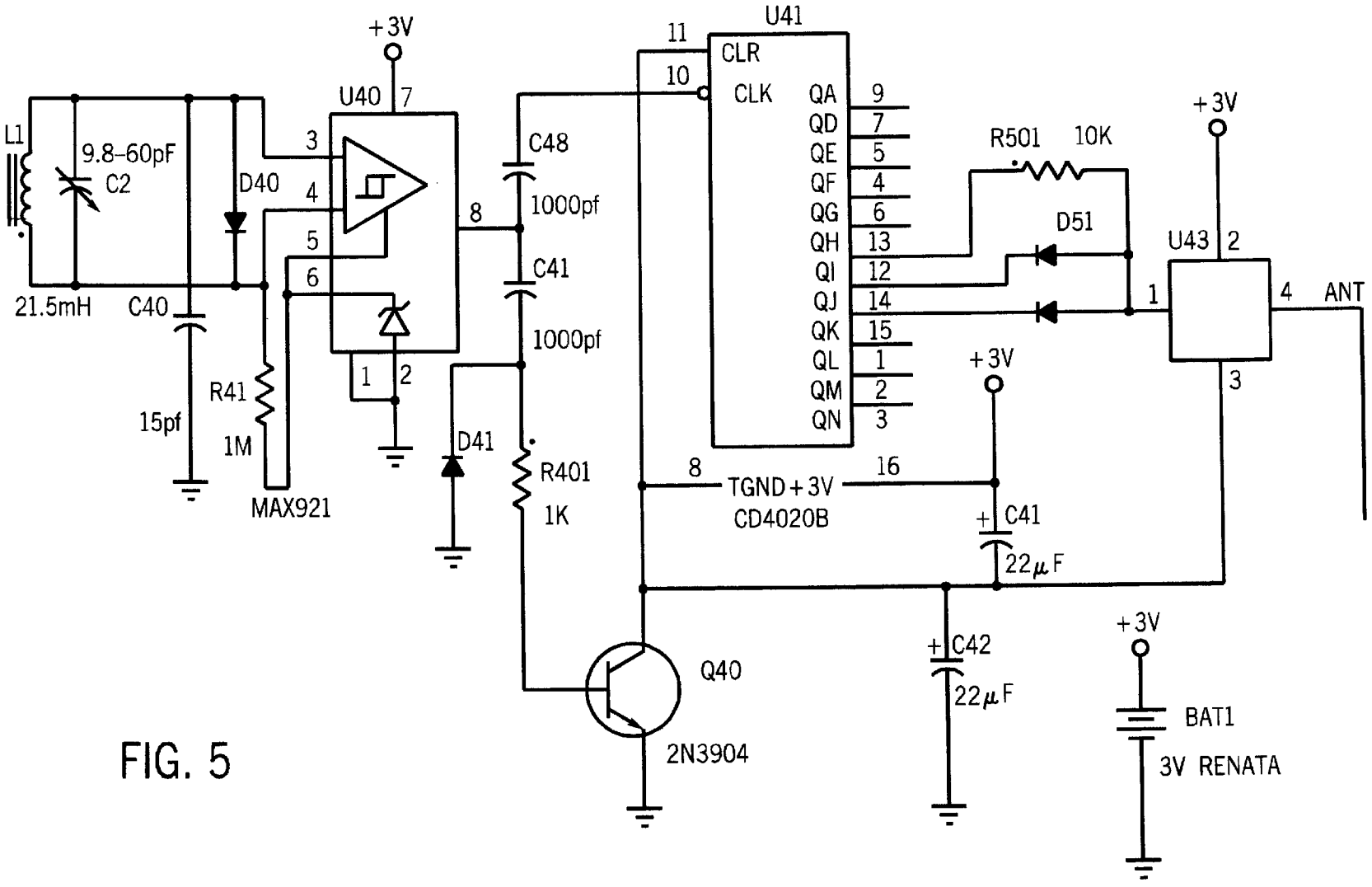
FIG. 5 is a circuit diagram of a patient tag constructed in accordance with the present invention.

An alternative embodiment omits the band removal feature. This embodiment may be particularly useful for adult patients who might wander off, such as those suffering from Alzheimer's disease. Also, the tags may simply emit a signal, without transmitting data. FIG. 5 shows a circuit that implements an alternative tag 102. The components of FIG. 5 have values identical to, and arranged the same as, the like numbered components of FIG. 4. However, the circuitry from FIG. 5 used to set the band removal alarm and to produce the data stream, have been removed. Also, three outputs of counter U41 are "OR'd" together by a resistor R501 (10k ohms) and a pair of diodes D51 and D52 to create a stream of narrow pulses at approximately 254 Hz, 257.75 Hz or 261.5 Hz, depending on the zone frequency.

Exit receivers 104 and internal receivers 109 are typically mounted in overhead locations and receive data from the tag transmitter. The exit and internal receivers perform any of three functions: detecting a tag near an exit (activated by an exit transmitter); detecting low battery signals; and detecting band removal alarms. Typically, only the exit receivers detect an activated tag, while any receiver may detect a band removal alarm or low battery signal.

Internal and exit receivers have a similar design, in the preferred embodiment, although their sensitivity is different. Exit receivers need only be sensitive enough to detect tags activated in their immediate vicinity. However, internal receivers may be widely separated, and a tag could be 100 or more feet from the nearest internal receiver. Thus, internal receivers must be able to detect tag signals from a much greater distance than exit receivers.

Figure 6A:
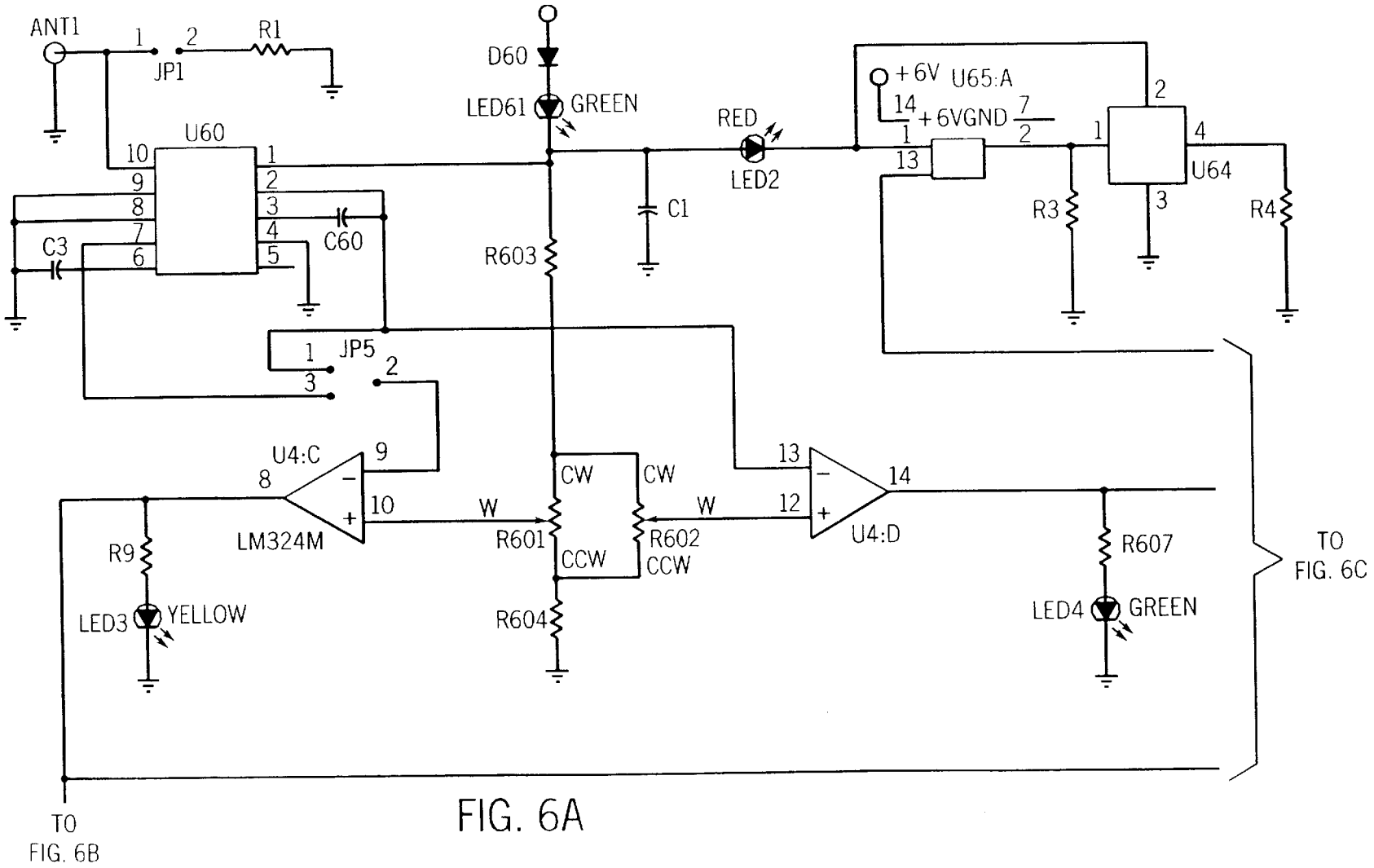
FIGS. 6A, 6B, and 6C are a circuit diagram of a receiver constructed in accordance with the present invention.
Figure 6B:
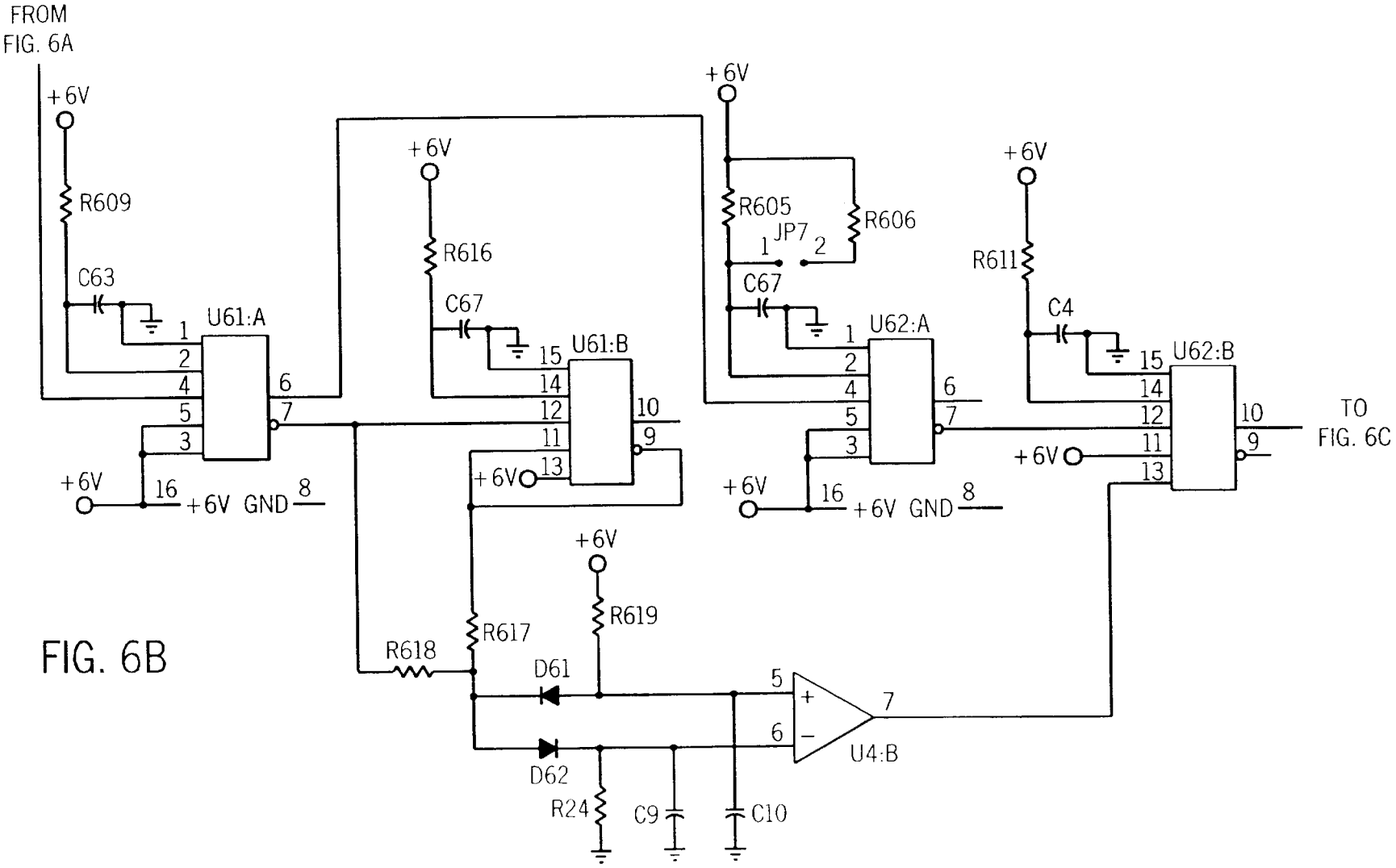
Figure 6C:
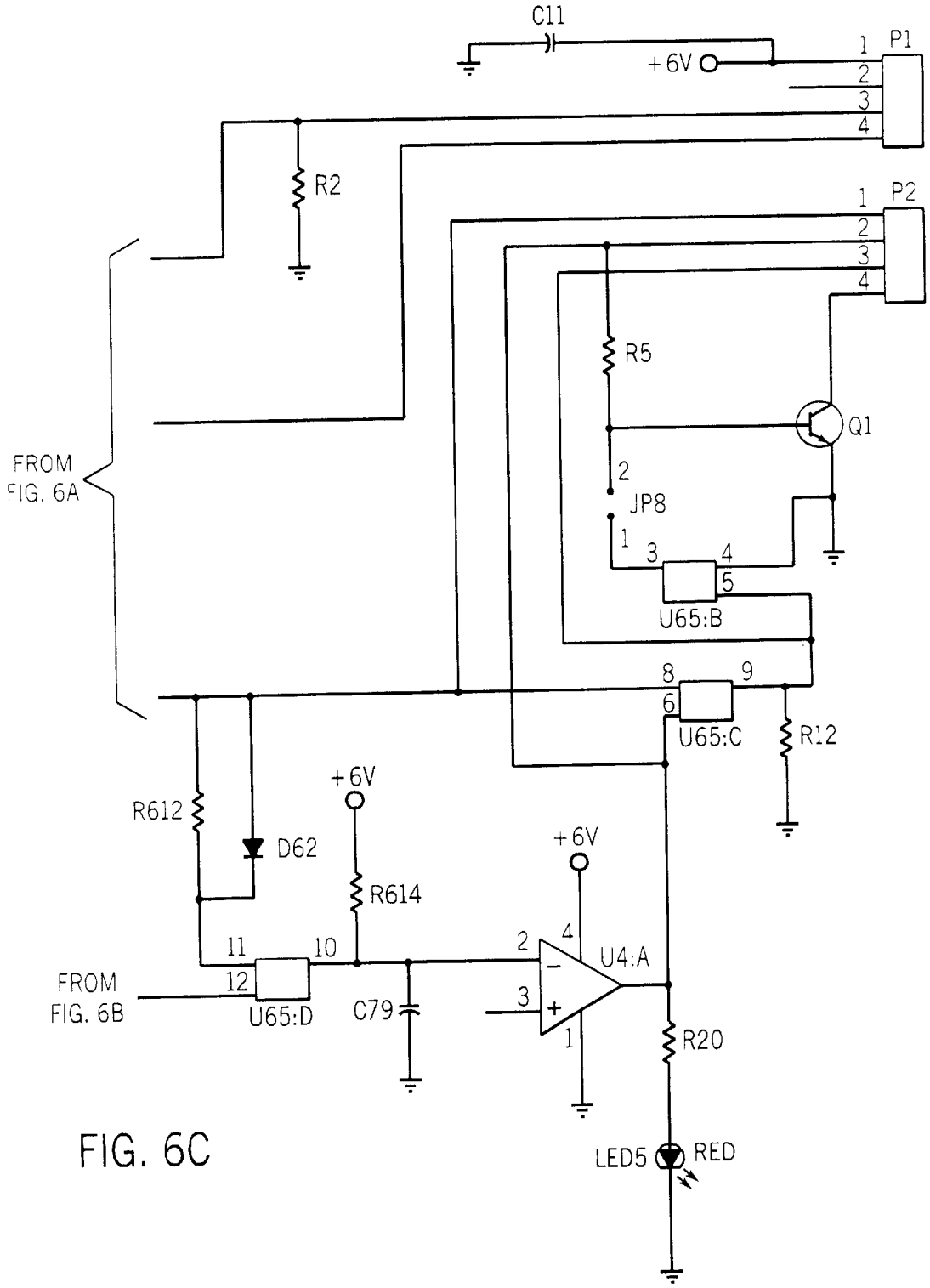

FIG. 6 is a circuit diagram of a receiver that may be adapted as either an internal receiver 109 or an exit receiver 104, and is particularly suited for detecting band removal or low battery signal. The digital data transmitted by the tag at 418 MHz is received by an antenna ANT1 and provided to a receiver U60 (an RX1000 ASH receiver chip). Receiver U60 outputs a digital data stream identical to the data stream generated in the tag. A capacitor C60 (1 $\mu$F) is connected to receiver U60.

Two separate detector circuits, with different sensitivities, are provided: one sensitivity is for detecting band removal signals, and the other for detecting tags activated by an exit transmitter. The band removal detector is built into receiver U60 and has a fixed threshold set for maximum sensitivity. As described above, it is preferable to have maximum sensitivity when "listening" for band removal signals, because the tags may be located 100 feet or so from the nearest overhead receiver. The preferred embodiment includes a jumper JP5 that may be used with a resistor R601 (up to 1K ohms) to adjust the band removal detector sensitivity downward in the event of high ambient noise conditions.

The other detector circuit is external to receiver U60 and has a variable sensitivity threshold, adjusted by a resistor R602 (up to 1K ohms). This detector output is connected to the system controller (described below). The adjustable detector allows receivers located near doors to be "de-sensitized" (limit their distance range) so that they receive only tag signals which originate very near the door being monitored. This way, signals from tags at other doors in the facility will not be detected. A diode D60, a diode LED61, a resistor R603 (220 ohms), and a resistor R604 (1k ohms) are connected to resistors 601 and 602.

The circuitry used for exit detection includes an op amp U4:D configured as a comparator that receives and buffers the output of receiver U63. Also, op amp U4:D level shifts the signal from 3 volts to 6 volts. The comparator has two inputs, one from receiver U63 and the other set by sensitivity resistor R602. This exit detector output signal is cabled back to the system controller to be processed, so it can trigger the door-lock or alarm function. Also, the output is provided through a resistor R605 (1K ohm) to a diode LED4 to indicate when a tag has been detected near an exit.

The circuitry used for band removal detection includes an op amp U4:C configured as a comparator that receives and buffers the output of receiver U60. Also, op amp U4:C level shifts the signal from 3 volts to 6 volts. The comparator has two inputs, one from receiver U63 and the other set by sensitivity resistor R601. The band tamper detector output signal is provided to a delay timer U61:A (MC14538) (also called a retriggerable one-shot). Timer U61:A is triggered by the first bit of the serial data from receiver U60 and stays triggered until the timer expires during the time interval between data bursts. A resistor R609 (13k ohms) and a capacitor C63 (1 $\mu$F) set the timing for timer U61:A.

The output of timer U61:A pin 6 is a series of negative-going pulses that occur just before the start of each data burst (about every 94 msec in the preferred embodiment). The output of timer U61:A pin 6 is provided to another timer U62:A (MC14538). Timer U62:A has an output on pin 7 that is a low-going delay pulse triggered on the trailing positive edges of the pulses from U61:A pin 6 (i.e., the start of data pulses). The pulses from U62:A last for a time determined by the RC time constant of a capacitor C68 (0.1 $\mu$F) and a resistor, R605 (56K ohms), resistor R606 (33K ohms), depending on the whether a jumper JP7 is installed. The pulses last persist for either 2 msec or 6 msec in the preferred embodiment.

Another timer U62:B (MC14538) is triggered by the trailing edge of pulses from timer U62:A, and creates a series of narrow delayed sampling pulses, about 1 msec wide in the preferred embodiment. These delayed pulses are time-aligned with either the first or second serial data bit, depending on whether jumper JP7 is installed. Data bit 1 goes low for band removal conditions, only and data bit 2 goes low for either a band removal condition or a weak battery condition, according to one embodiment. A resistor R611 (5.6k ohms) and a capacitor C65 (0.1 $\mu$F) set the timing for timer U62:B.

A sample-and-hold circuit is comprised of switch U65:D (MC14066) and a capacitor C67 (1 $\mu$F). The sample and hold circuit samples during the narrow sampling window generated by timer U62:B (either the first or second data bit). The data bit is provided a diode D62 and a resistor R612 (4.7K ohms). The sample and hold circuit generates an integrated logic signal, 0 or 1, depending on whether the data bit being sampled every 94 msec is low or high. Resistor R612 integrates the sampling of the data signal so that multiple samples are required to change the state of the sample-and-hold output. This minimizes false alarms due to noise. A resistor R614 (1M ohm) forces the sample-and-hold to the high state in the absence of received data. An op amp U4:A buffers the sample-and-hold output and it is provided as an alarm output for either band removal and/or low battery conditions.

Circuitry which helps avoid noise-induced false alarms by inhibiting the sample-and-hold circuit unless certain conditions are met includes a timer U61:B (MC14538) and an op amp U4:B configured as a comparator. The reset input of timer U61:B is driven by op-amp/comparator U4:B. A capacitor C67 (1 $\mu$F) and a resistor R616 (10k ohms) set the timing for timer U61:B.

The waveform on timer U62:A pin 7 is a repetitive string of 12 msec wide, negative going, data sync pulses occurring every 94 msec when data is being received. Timer U61:A generates a fixed 12 msec pulse which is coincident, but opposite polarity of the pulses at timer U62:A pin 7. When a valid tag signal is being received, these two signals appear to be equal and opposite. However, intermittent noise creates a more random waveform at timer U62:A pin 7, and this is used to distinguish between valid and noise-created signals. Thus, this is a discrimination circuit that determines if a valid signal has been detected.

Timer U61:B triggers when timer U61:A times out, so timer U61:B is actually being used to measure how much time elapses before timer U61:A is re-triggered by the next data word. The two mirrored waveforms are summed together by a pair of resistors R617 and R618 (100K ohms), and a DC voltage of 3 V is created. Thus, a valid tag signal produces waveforms on timer U61:A pin 7 and timer U61:B pin 9 that are mirror images of each other, but with different timing intervals and trigger times. When summed together by resistors R617 and R618, the result is a flat DC voltage.

A pair of resistors R619 and R620 (1M ohm) cause capacitor C70 to charge to 3.7 V and capacitor C69 to discharge to 2.3 V. This causes the output of op amp U4:B to go high, enabling timer U62:B.

However, if random noise is being received, the pulses on timer U61:A pin 7 will vary in width from pulse to pulse and timer. Timer U61:B will generate a random sequence of fixed 12 msec pulses. When these two signals are summed together by resistors R617 and R618, an erratic waveform which will intermittently deviate from 3 V, swinging to ground and the +6 V rail results. As this happens, a diode D61 discharges a capacitor C69 (1 $\mu$F) with low-going noise pulses, and a diode D4 charges a capacitor C70 (1 $\mu$F) with positive going pulses.

When deviations occur at the summing junction of resistors R617 and R618 (due to invalid signals), the influence of R619 and R620 is interrupted, and the voltages on capacitors C69 and C70 are juxtaposed, i.e., the voltage levels cross. When these voltages cross, the output of op amp U4:B goes low, inhibiting timer U62:B. When timer U62:B is disabled by op amp U4:B, the sample-and-hold circuit is disabled and no alarm sounds. The waveforms created by valid signals and noise are shown in FIGS. 7 and 8.

An alternative embodiment screens false alarms by simply integrating the waveform on timer U62:A pin 6 to create a slow DC threshold voltage which varies as a function of the duty cycle on timer U61:A pin 6. In this alternate configuration, op amp U4:B enables timer U62:B only if the integrated DC voltage is above a reference voltage on the minus input. The output of op amp U4:B will only go high if the duty cycle on timer U61:A pin 6 integrates to a voltage which is higher than the reference voltage. If noise is present, the integrated waveform will likely be below the reference voltage, and the output of op amp U4:B will be low. If the output of op amp U4:B is low, timer U62:B is held in reset, inhibiting the sample-and-hold circuit. However, since timer U61:A is retriggerable, it will stay triggered under conditions of high noise and will not forward a consistent stream of pulses to trigger timer U62:B. Thus, the criteria that must be met for timer U62:B to open the sampling window is: 1) the waveform on timer U61:A pin 6 must integrate to a fairly high DC voltage, and 2) it cannot integrate too high, (indicating too much noise is present) because timer U61:A will output a steady-state signal which won't trigger timer U62:B. A valid tag signal will meet the narrow window of acceptable signal criteria. Random noise may also meet this criteria sporadically, but the sample-and-hold integration of resistor R612 demands that repetitive samples continually discharge C66 in order to overcome the influence of resistor R614, which wants to keep it charged. In other words, the sporadic noise would have to be sustained for at least several hundred milliseconds to generate an alarm output, and would have to continue in order to hold the alarm on.

A pair of switches U65:B and U65:C are used to switch data on or off to an output, depending on whether an alarm condition exists. This is done to prevent noise from being present at that output. A transistor Q61 creates an optional open-collector (tri-state) output, for the output so that overhead receivers can be daisy-chained, or share a common signal line back to the equipment room. Switch U65:B, and a jumper JP8 and a resistor R622 (1K ohms) are used to select whether the tri-state output sends serial or merely an open/low alarm signal.

A 418 MHz transmitter U2 is part of the system supervisor (described below) and is periodically energized by a pulsed signal from the system controller (in exit receiver applications). It emits a pulsed signal simulates a valid tag signal, which is received by receiver U60. This may be used periodically test of the overhead receiver, as well as the signal processor circuitry in the system controller.

Figure 9A:
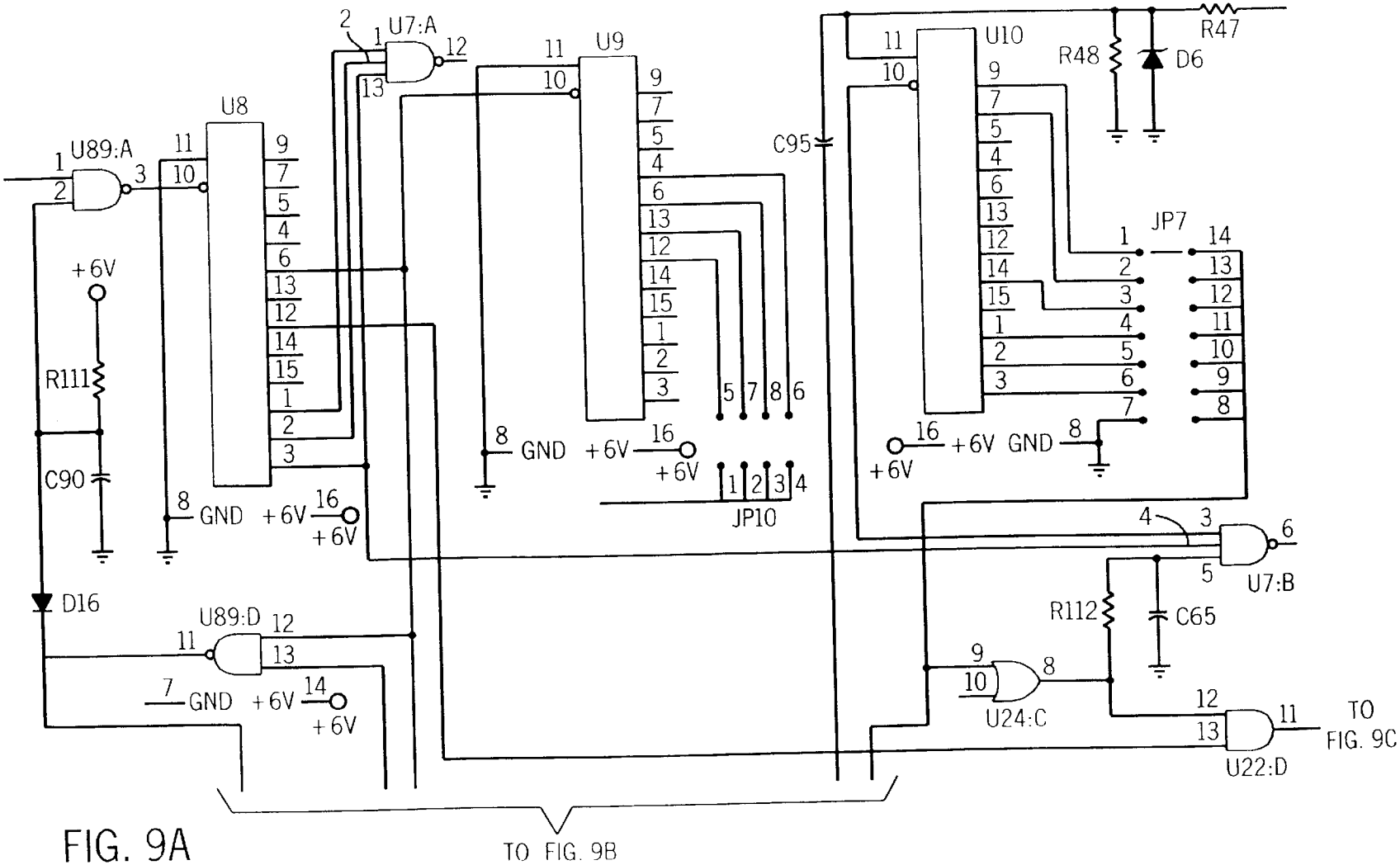
FIGS. 9A, 9B, and 9C are a circuit diagram of a controller constructed in accordance with the present invention.
Figure 9B:
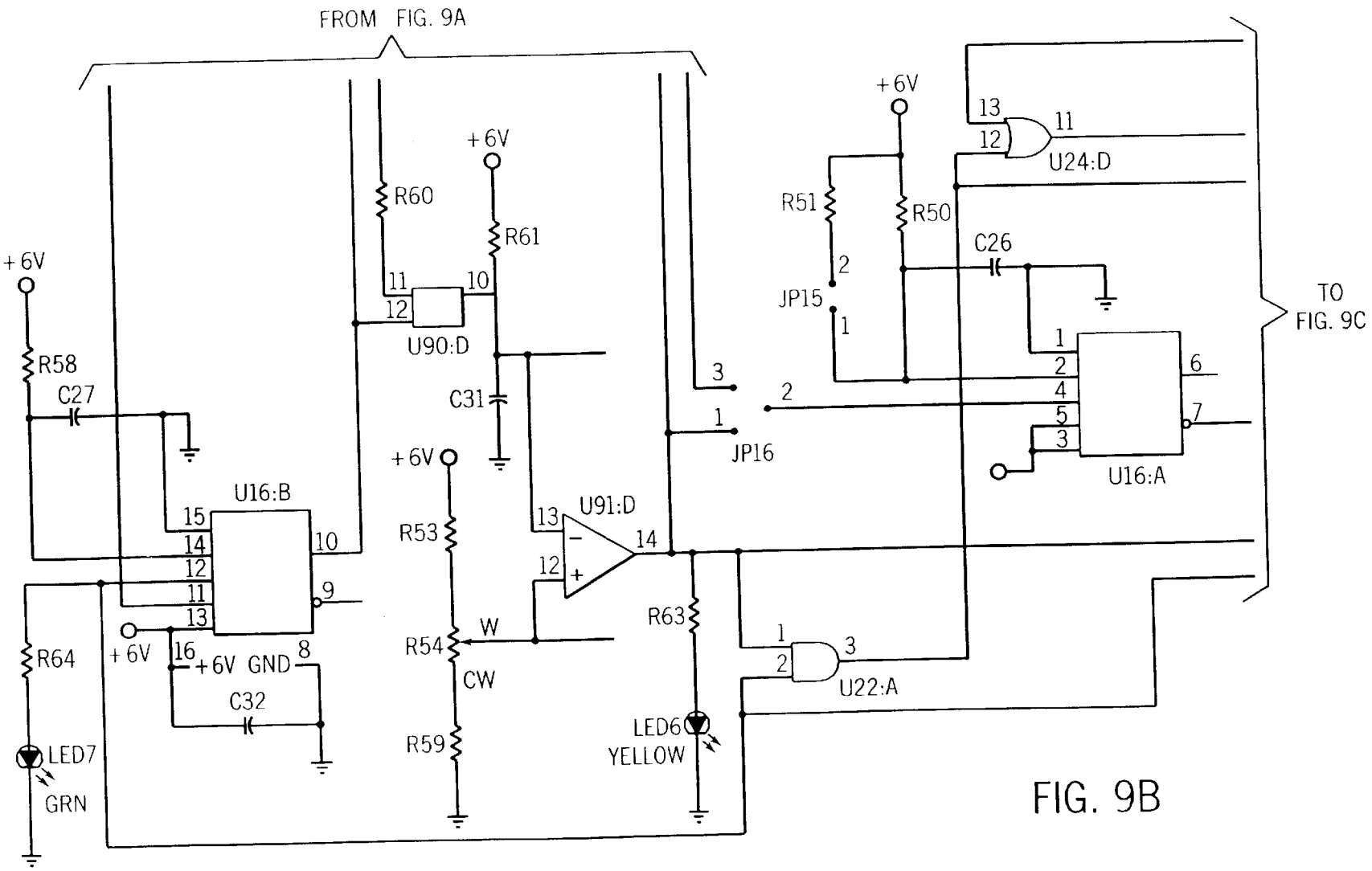
Figures 9A, 9B, 9C:
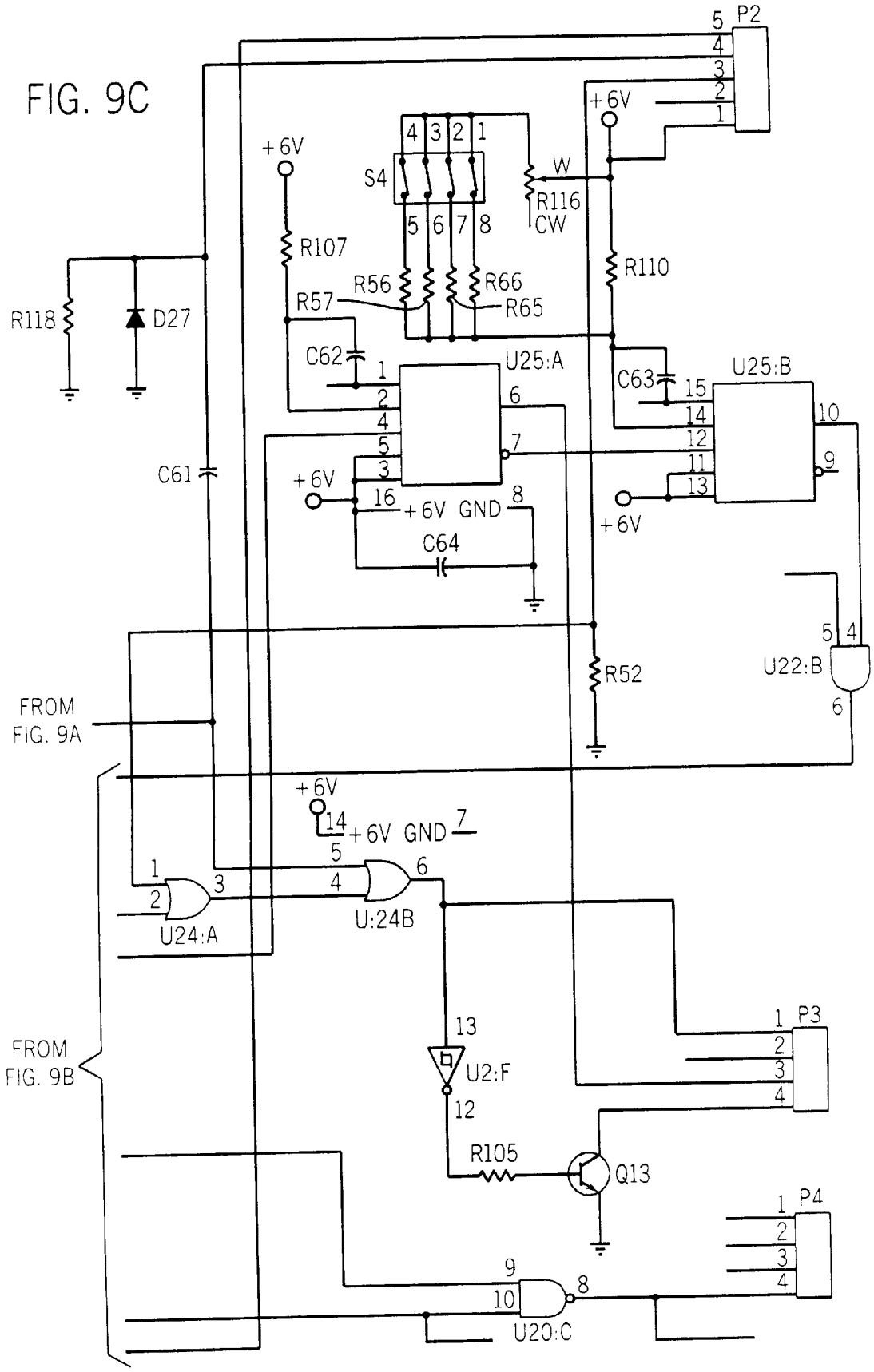

FIG. 9 is a schematic of the signal processor or controller. Each individual bit of data, created by an infant tag whether a 1 or a 0, is preceded by a narrow positive voltage transition, or start bit. A Monostable multivibrator (one-shot) U16:B is essentially a timer which generates a narrow 75 μsec pulse each time a positive voltage transition occurs. The 75 μsec pulse is generated for each data bit received by receiver U60, occurring at a repetition rate depending on the TX frequency which is activating the tag. For example, approximately every 3.88 msec (257.75 Hz). Circuitry associated with timer U16:B includes a pair of resistors R58 (75K ohms), R64 (470 ohms), a pair of capacitors C32 (0.01 μF) and C27 (0.001 μF), and diode LED7 (that indicates when a signal is received). The input to timer U16:B is connected to the RX DATA signal. A counter U8 (74HC4020) is identical in function to counter U41 of the tag. Counter U8 samples the 132 KHz TX CLOCK signal from the TX OSCILLATOR/DRIVER and divides it by 128, to generate a 1031 Hz square wave signal whose half-cycle period is wide enough to encompass the 75 μsec pulses occurring at 257.75 Hz from timer U16:B. Circuitry associated with counter U8 include a NAND gate U90:A (which receives the TX CLOCK as an input), a resistor R111 (47K ohm) an a capacitor C90 (0.022 μF).

The timing relationship of the 75 μsec pulses generated by timer U16:B from tag data, and the 1031 Hz square wave from counter U8, is such that all the pulses in a data stream will fall in time-alignment with the square wave only if the tag data is synchronized to the 132 KHz TX signal of that transmitter/receiver. Synchronous, as used herein, means having a constant or fixed phase relationship. Thus, when synchronized, all 75 μsec pulses will occur during the high state of the square wave, or all pulses will occur during the low state of the square wave, or all pulses may align with the edge transitions of the square wave.

If the 75 μsec pulses from timer U16:B have the same phase relationship with the square wave from counter U8 for a significant amount of time, then a valid tag signal being received. Whether of not the phase relationship is consistent can be determined by taking a voltage sample of the square wave each time a 75 μsec pulse occurs. This is done with a switch U90:D and a sample-and-hold circuit. Switch U90:D is a bilateral switch, or electronic relay, which closes for 75 μsec each time a pulse occurs. The square wave voltage is momentarily supplied through a resistor R60 (5.6K ohms), and begins charging or discharging a capacitor C31 (0.1 μF), depending on if an individual pulse happens to coincide with the high or low state of the square wave. (Which state it coincides is a random function of when the tag enters the zone.) If the pulses coincide with the high state, capacitor C31 will charge through resistor R60 toward +6 V. If they coincide with the low state, capacitor C31 discharges through resistor R60 towards ground. If the pulses coincide with the transition edges, capacitor C31 can charge to any voltage between 0 V and 6 V.

An invalid tag or noise signal will produce a random sampling of the square wave and will cause C31 to sometimes charge, sometimes discharge, to an average voltage which bounces somewhere around 3 V. Monitoring the voltage on capacitor C31 allows a valid tag signal to be detected.

The preferred embodiment detects alignment of the data pulses aligned with the negative half-cycles of the square wave. Thus, in order to be able to detect a valid tag signal, synchronous 75 μsec data pulses are forced to line up with the low state of the square wave. The sample-and-hold circuit will therefore always sample the low state of the square wave and will discharge capacitor C31 towards 0 V for a valid tag signal. When the voltage on capacitor C31 drops below a threshold voltage set by a trim pot resistor R54 (up to 20K ohms), a resistor R53 (5.6k ohms) and a resistor R59 (1K ohms), a comparator 91:D switches high, signaling a valid detect. Valid detection occurs when the integrated sample voltage crosses the detection threshold voltage.

The circuit used to force alignment between valid data pulses and the negative half-cycles includes a pair of NAND gates U89:A and U89B. Gate U89:D compares the relationship between the 75 μsec pulses and the 1031 KHz square wave. If the 75 μsec pulses align with the high state of the square wave, it is necessary to "bump the alignment" to force the low state of the square wave to line up with the 75 us pulses. If the initial alignment happens to be with the positive half-cycles of the square wave, gate U89:D outputs a 75 μsec low-going pulse which is stretched to about 100 msec by a diode D16, resistor R111 and capacitor C60. This 100 μsec pulse gates off the 132 KHz input of U8, suspending the count for that duration of time during the square wave's high state. Effectively, this changes the phase angle of the square wave from counter U8 with respect to the incoming 75 μsec pulse stream, offsetting the timing difference with each subsequent 75 μsec pulse until low-state alignment is achieved. If the initial alignment is on the edge of the square wave, the jump in phase angle will also cause alignment with the low state. Once the 75 μsec pulses are aligned with the low state of the 1031 KHz square wave, gate U89:A pin 2 remains high so that the 132 KHz clock to U8 is not interrupted. The two waveforms remain synchronously locked with the sample window always falling in the low state of the square wave for a valid tag signal. At this point, gate U89:D remains high, constantly enabling gate U89:A.

Since adjacent systems are set to an alternate TX frequency, data pulses coming from a tag at the wrong door do not consistently line up with the square wave, and C31 is alternately charged and discharged as these non-synchronous pulses occur. As the non-synchronous square wave is sampled, the integrated voltage will average out to a level which bounces around 3 V. Furthermore, if random noise pulses are present, the samples will also average out to around 3 V. If no data pulses are present, capacitor C31 is charged to +6 V through a resistor R61 (10M ohms). Capacitor C31 will only discharge below a threshold of about 1.2 V, set by R54, if many consecutive 75 μsec pulses are in alignment with the low state of the square wave, indicating valid data pulses are being received.

Data pulses originating from tags at other doors will not line up with the square wave: i.e., some pulses will fall during the square wave's high state and others during the low state. An insufficient number of consecutive pulses will coincide with the square wave, so no detection will occur.

The time constant of resister R60 and capacitor C31 dictate how many consecutive low-state synchronous pulses it takes to detect a valid data stream. If this time constant is set too short, false alarms can occur if pseudo-random noise pulses happen to line up with the square wave for short intervals. If the time constant is set too long, a tag can penetrate farther into the zone before a valid detect signal appears.

To further discriminate against false alarms, a one-shot timer U16:A (MC14538) is used to delay detection of a series of pulses until the sample-and-hold voltage remains below the detection threshold for a certain period of time, about 100 msec. A jumper JP15 can be removed to further lengthen the delay. A jumper JP16 selects whether the detection is delayed by timer U16:A, or response is immediate. The added delay might be necessary in a noisy environment at 418 MHz. The circuitry associated with the delay includes a resistor R51 (22K ohms), a resistor R50 (22K ohms), and a capacitor 26 (10 μF).

The preferred embodiment uses the law of averages to discriminate between a valid and invalid data stream. The likelihood of sufficient number (2000 e.g.) of aligned pulses (other than from a valid signal) is extremely low. The detect threshold is set to about 1.2 V (out of the 6 V). It may take 20 valid reads in a row, or more if the delayed detect mode is selected by jumpers JP16 and JP15 to initiate an alarm. One valid read may be 80 of 100 pulses aligned.

An alternate embodiment method forces each data pulse to align with the square wave by clearing counter U8 just after each data pulse. The QE through QK outputs of U8 will all be high at the moment that the next data pulse is expected. These outputs are "ANDed" with the data pulse to generate a series of very narrow spikes when valid data is present. If data pulses from another zone are present, or random noise pulses, there is a timing mismatch between the counter outputs and the data pulse, and no spike will be present. Presence of a series of spikes indicates a valid detection.

Valid tag data is gated through AND gate U22:A and a series of OR gates (U24:A–D) to an output which feeds a microprocessor-based computer interface unit. The interface unit monitors inputs from multiple zones or overhead receivers, and converts the tri-state data stream to an RS-232 compatible output which can be processed by computer software to display the location and ID of an alarm or other event. The software can recognize whether the door is open or closed, so that it can register an event as an exit alarm or just an indication of a tag near the door.

A pair of timers U25:A and U25:B (MC14538) create a short pulse about 5 msec following each burst of tag data. If the magnetic switch on the door indicates it is open, this extra pulse is gated onto the end of each data word by an AND gate U22:B to flag the alarm condition. The software looks for this extra pulse as an indication of alarm status. Circuitry associated with timers U25:A and U25:B (for setting times etc.) include resistors R107 (75K ohms), R56 (1M ohm), R57 (720K ohms), R65 (470K ohms), R66 (220K ohms), R116 (up to 20K ohms), and R110 (1M ohm), capacitors C62 (0.1 μF), C63 (0.01 μF), and C54 (0.01 μF) and a switch S4.

The preferred embodiment includes a self-diagnostic feature to periodically test by activating an on-board tag. The system responds as if a tag was in the zone, except that the system does not alarm for a self-diagnostic test. Reception and detection of tag signals, are periodically verified using timers U9 and U10 (74HC4020) which form a slow timer to set how often the system is supervised. When the output of timer U10 selected by a jumper JP27 goes high, synchronized pulses from counter U8 pin 12 are gated through gate U22:D to modulate an on-board 418 MHz transmitter U64 (FIG. 6). This generates a simulated valid tag signal, creating synchronized pulses in receiver U60. As these pulses are received the circuitry generates a valid detection pulse which passes through a capacitor C25 (0.1 μF), quickly resetting timer U10. This, inturn, inhibits the simulated tag signal generated by transmitter U64. This happens so quickly that timer U4:B does not produce a low-going valid detect signal due to the delay in timer U16:A. Even if jumper JP16 is in a non-delay mode, a delay still occurs to inhibit the detection of the supervisor signal. If timer U10 fails to reset because of a circuit problem or receiver interference, timer the supervisor will sound an alarm that continues until the problem is corrected. Circuitry associated with timer U10 includes a resistor R48 (10 ohms), a zener diode D90, and a resistor R47 (5.6k ohms). The alarm is driven by pulses from a gate U7:B (74HC10). A resistor R112 (82k ohms) and a capacitor C65 (1 μF) slightly delay the supervisor alarm so that a short "chirp" is not heard when supervision occurs.

TX output is verified by sampling the low frequency transmit energy from the three door loop antennas with circuitry shown on FIG. 6. A DC voltage C21 (0.011 μF) which is inversely proportional to the 132 KHz transmitter output voltage. This DC voltage on capacitor C1 is compared to a threshold voltage set by a resistor R34, (up to 10K ohms). If it is higher (indicating that the TX signal is too low) gates U24:C and U7:B enable the supervisor alarm output. A capacitor C16 (10 μF) stretches the high-going signal to assure detection if any of the X, Y and Z channel TX outputs is to low,—X, Y or Z.)

The switching, timing and power supply circuitry that activate and holds door locks, deactivates elevators and switches audible alarms are conventioned, such as those found in the prior art. An override interface with an external fire alarm system may disengages the locks in case of fire. An external input allows the alarm function to be triggered by an external source, such as the computer interface.

A diagnostic display may be used by service personnel to set up and test a system once it is installed. The level or strength of the 132 KHz TX signal (and preferably indicated by a flashing LED bar) and the supervisor threshold level are shown. Also the averaged input sample voltage, or detection level, with a non-flashing LED bar indicating the actual detection threshold for a valid detect. Resistors may be used to set the various levels.

Numerous modifications may be made to the present invention which still fall within the intended scope hereof. Thus, it should be apparent that there has been provided in accordance with the present invention a method and apparatus for monitoring a patient that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A system for monitoring a person in a secured zone comprising:

at least one transmitter mounted to transmit a first signal into the zone;

at least one tag to be worn on the person, wherein the tag includes a receiver that receives the first signal, and a tag transmitter that transmits a second signal, wherein the second signal is responsive to, and at a fixed phase with respect to the first signal;

a receiver disposed to receive the second signal and provide a third signal responsive to the first signal; and a controller connected to the receiver, wherein the controller includes a discrimination circuit that determines if the third signal is responsive to the first signal and provides an alarm signal if responsiveness is found.

2. The system of claim 1 wherein the controller includes a phase discrimination circuit that determines if the third signal has a fixed phase relationship with the first signal.

3. The system of claim 1 wherein the transmitter is a transmitter that transmits at a first fixed frequency.

4. The system of claim 3 wherein the first fixed frequency is one of a plurality of selectable frequencies.

5. The system of claim 3 wherein the tag transmitter is a transmitter that transmits at a second fixed carrier frequency and a data frequency, wherein the data frequency is responsive to the first frequency.

6. The system of claim 1 further including an antenna connected to the transmitter, wherein the antenna includes a plurality of loops, and each loop is disposed in a unique plane, and each unique plane is substantially perpendicular to the other unique planes.

7. The system of claim 1 wherein the tag includes a tag removal circuit that senses the skin resistivity of the person.

8. The system of claim 1 wherein the tag includes a chest band and senses the respiration of the person.

9. The system of claim 1 wherein the tag includes a power circuit that reduces power consumption in the event the second signal is not being transmitted.

10. A system for monitoring a person in a secured zone comprising:

at least one transmitter means for transmitting a first signal into the zone;

at least one tag to be worn on the person, wherein the tag includes a receiver means for receiving the first signal, and a tag transmitter means for transmitting a second signal into the zone, wherein the second signal is responsive to, and at a fixed phase with respect to, the first signal;

a receiver means for receiving the second signal and providing a third signal responsive to the first signal; and a controller connected to the receiver means, wherein the controller includes a discrimination means for determining if the third signal is responsive to the first signal and for providing an alarm signal if responsiveness is found.

11. The system of claim 10 wherein the controller includes a phase discrimination means for determining if the third signal has a fixed phase relationship with the first signal.

12. The system of claim 10 wherein the transmitter means includes means for transmitting at a first fixed frequency.

13. The system of claim 12 wherein the tag transmitter means includes means for transmitting at a second fixed carrier frequency and a data frequency, wherein the data frequency is responsive to the first frequency.

14. The system of claim 10 further including an antenna connected to the transmitter, wherein the antenna includes a plurality of loops, and each loop is disposed in a unique plane, and each unique plane is substantially perpendicular to the other unique planes.

15. The system of claim 10 wherein the tag includes a tag removal means for determinign if the tag is removed.

16. The system of claim 10 wherein the tag includes a means for sensing the respiration of the person.

17. The system of claim 10 wherein the tag includes a power circuit means for reducing power consumption in the event the second signal is not being transmitted.

18. A method for monitoring a person wearing a tag in a secured zone comprising the steps of:

transmitting a first signal into the zone;

receiving the first signal at the tag;

transmitting a second signal from the tag, wherein the second signal is responsive to, and at a fixed phase with respect to, the first signal;

receiving the second signal and providing a third signal responsive to the first signal; and determining if the third signal is responsive to the first signal and providing an alarm signal if responsiveness is found.

19. The method of claim 18 including the step of determining if the third signal has a fixed phase relationship with the first signal.

20. The method of claim 18 including the step of transmitting the first signal at a first fixed frequency.

21. The method of claim 20 including the step of transmitting the second signal at a second fixed carrier frequency and a data frequency, wherein the data frequency is responsive to the first frequency.

22. The method of claim 18 including the step of senses when the tag is removed.

23. The method of claim 18 including the step of sensing the respiration of the person.

24. The method of claim 18 including the step of reducing power consumption in the event the second signal is not being transmitted.

* * * * *